US005533304A

United States Patent [19]

Noble

[11] Patent Number: 5,533,304

[45] Date of Patent: Jul. 9, 1996

[54] ADJUSTABLE ANTENNA SUPPORT

[75] Inventor: Myron C. Noble, Plymouth, Ind.

[73] Assignee: Pi-Rod, Inc., Plymouth, Ind.

[21] Appl. No.: 420,030

[22] Filed: Apr. 11, 1995

[51] Int. Cl.[6] ..... H01Q 1/12

[52] U.S. Cl. ..... 52/40; 52/114; 52/736.2; 52/651.07; 343/890; 343/880

[58] Field of Search ..... 52/40, 29, 736.2, 52/651.07, 114; 248/289.1, 186, 521; 343/890, 891, 880, 882

[56] References Cited

U.S. PATENT DOCUMENTS

| | | | |
|---|---|---|---|
| 1,930,314 | 10/1933 | Healy et al. | 52/40 X |
| 2,698,873 | 1/1955 | Allsworth et al. | 52/40 X |
| 3,358,952 | 12/1967 | Burns | 343/890 X |
| 3,638,891 | 2/1972 | Schlosser | 52/40 X |
| 4,763,132 | 8/1988 | Juds et al. | 343/890 |
| 4,799,067 | 1/1989 | Tekip et al. | 343/891 X |

*Primary Examiner*—Robert J. Canfield
*Attorney, Agent, or Firm*—Baker & Daniels

[57] ABSTRACT

An adjustable antenna mount that includes one or more support arms extending outward from a central tower or mast, with each support arm supporting a pivoting cross member on which an antenna assembly is mounted. Each antenna assembly is pivotable about the cross member, and the ends of the cross member and hence the antennas can be accessed from the relative safety of the mast by swiveling the ends of the cross member to a position near the mast. The present invention not only enables the rotation and angle of each antenna to be fine tuned, but also dispenses with the need for a convention work platform at the top of the mast. As such, the present invention presents a much lower wind profile, thereby enhancing signal quality by preventing oscillation of the support in certain high wind conditions.

16 Claims, 4 Drawing Sheets

ADJUSTABLE ANTENNA SUPPORT

BACKGROUND OF THE INVENTION

This invention relates in general to antenna support towers. More particularly, this invention relates to an adjustable antenna mount that allows one or more antennas to be independently adjusted or tuned in a variety of directions, and further allows for safe and ready access to the antennas for servicing, adjusting, or replacing. Finally, this invention relates to an antenna mount that offers a more aerodynamic wind profile, thereby preventing signal interference by reducing oscillation in certain conditions.

Antenna towers have long been used in the transmission, reception, and forwarding of radio and television signals, and are generally well known in the art. The demand for such towers is rapidly increasing in response to the booming demand for cellular phones and other applications requiring the transmission of microwave signals. A typical tower assembly is shown and described in U.S. Pat. No. 5,333,436, which shows a number of antennas mounted to a platform, which in turn is attached to the top of a tower.

Antennas need to be adjusted or tuned in order to optimize the transmission or reception of signals. Additionally, because the typical transmission tower may be up to 200 feet high, the antennas must easy to install, adjust, and service. Therefore, an antenna support must offer safe and easy access for service personnel. In order to provide access, many existing designs utilize a service platform that is surrounded by a complicated framework to which the antennas are attached. Unfortunately, such designs present a larger wind profile making them more prone to oscillation in high winds, which can interfere with the signal quality.

SUMMARY OF THE INVENTION

The present invention eliminates the need to include a service platform on the top of transmission towers by providing safe and easy access to one or more antennas. The present invention combines an improved low profile elongated support arm with a pivoting antenna cross member, thus allowing service personnel to position an antenna where it can be adjusted or serviced from the relative safety of the support structure, which eliminates the need to construct a bulky service platform.

The present invention also allows each antenna mounted on the structure to be independently tuned or adjusted in a number of directions, and simplifies the mounting of each antenna. Therefore, a slight adjustment to one antenna will not affect the performance of another antenna on the same tower.

Finally, the present invention relates to an improved mounting apparatus that offers a lower wind profile, thus reducing the negative effect of high winds on signal transmission. The low profile design also lowers construction costs by reducing the need for guy wires and/or allowing the use of a lighter support structure.

Accordingly, it is an object of this invention to provide an adjustable antenna support device that allows one or more antennas to be independently adjustable in a variety of directions.

Another object of this invention is to provide an antenna support that eliminates the need for a service platform and allows the antennas to be easily rotated to a servicing position.

A still further object of this invention is to provide an adjustable antenna mount that presents a low wind profile, thereby reducing or eliminating the need for guy wires and reducing the deleterious effects of high winds.

Other objects of the invention will become readily apparent to one skilled in the art upon a reading of the following description.

DESCRIPTION OF THE PREFERRED EMBODIMENT

Figure 1:
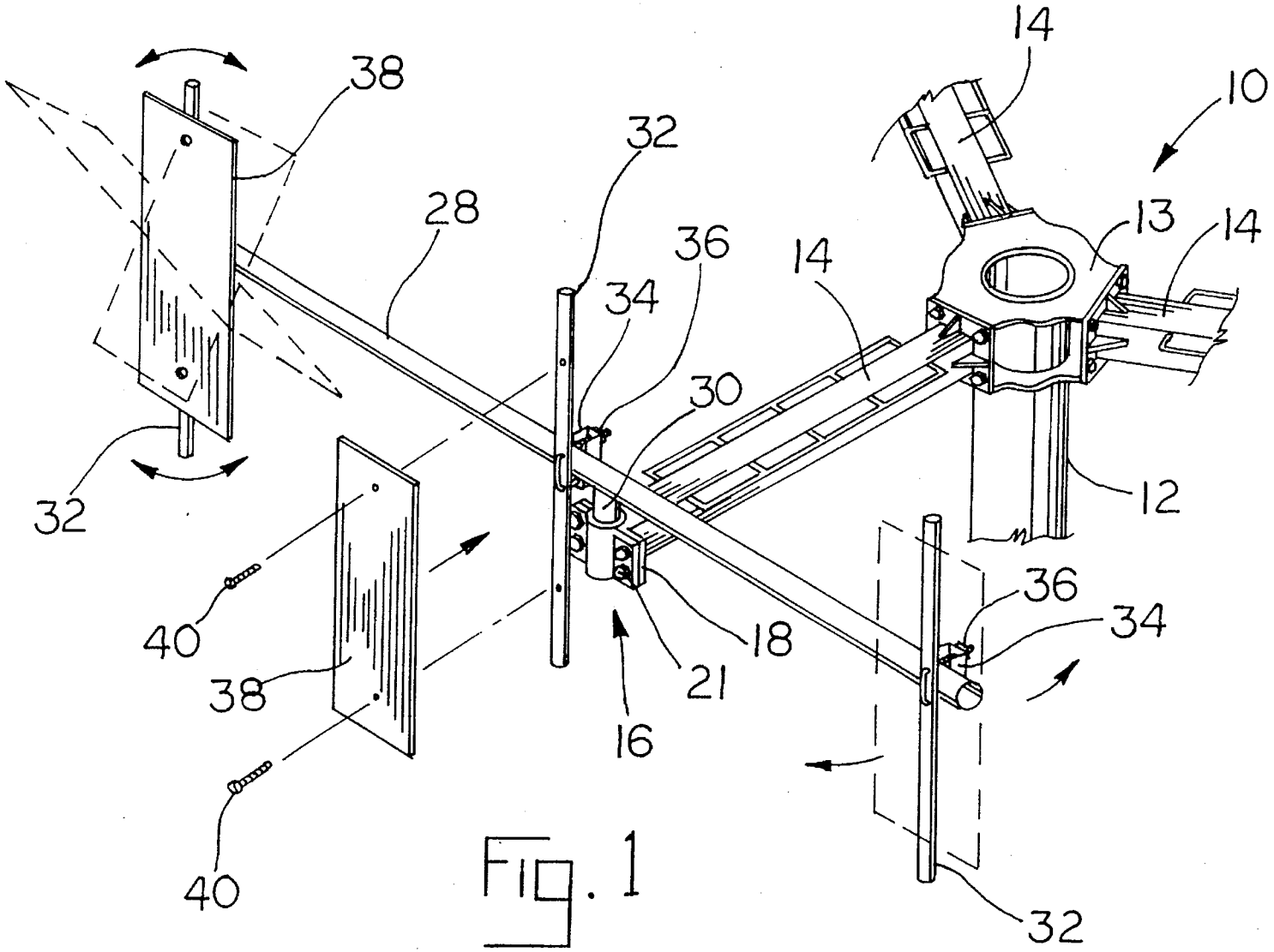
FIG. 1 is fragmentary perspective view of an adjustable antenna support device made according to the present invention.
Figures 2, 3:
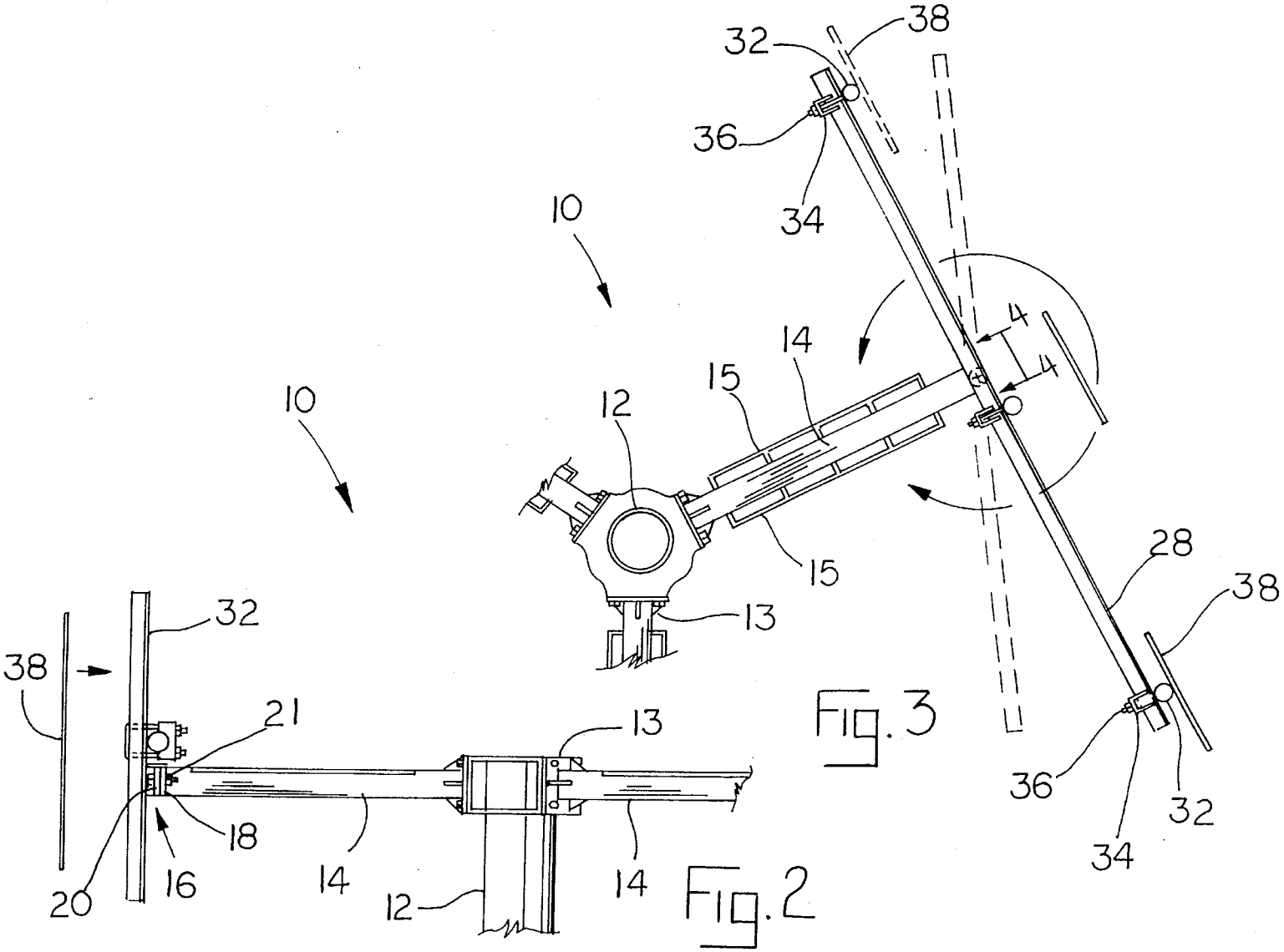
FIG. 2 is a fragmentary elevational view of the adjustable antenna support device shown in FIG. 1.
FIG. 3 is fragmentary plan view, taken from above, of the antenna support device shown in FIGS. 1 and 2.
Figures 4, 5, 6:
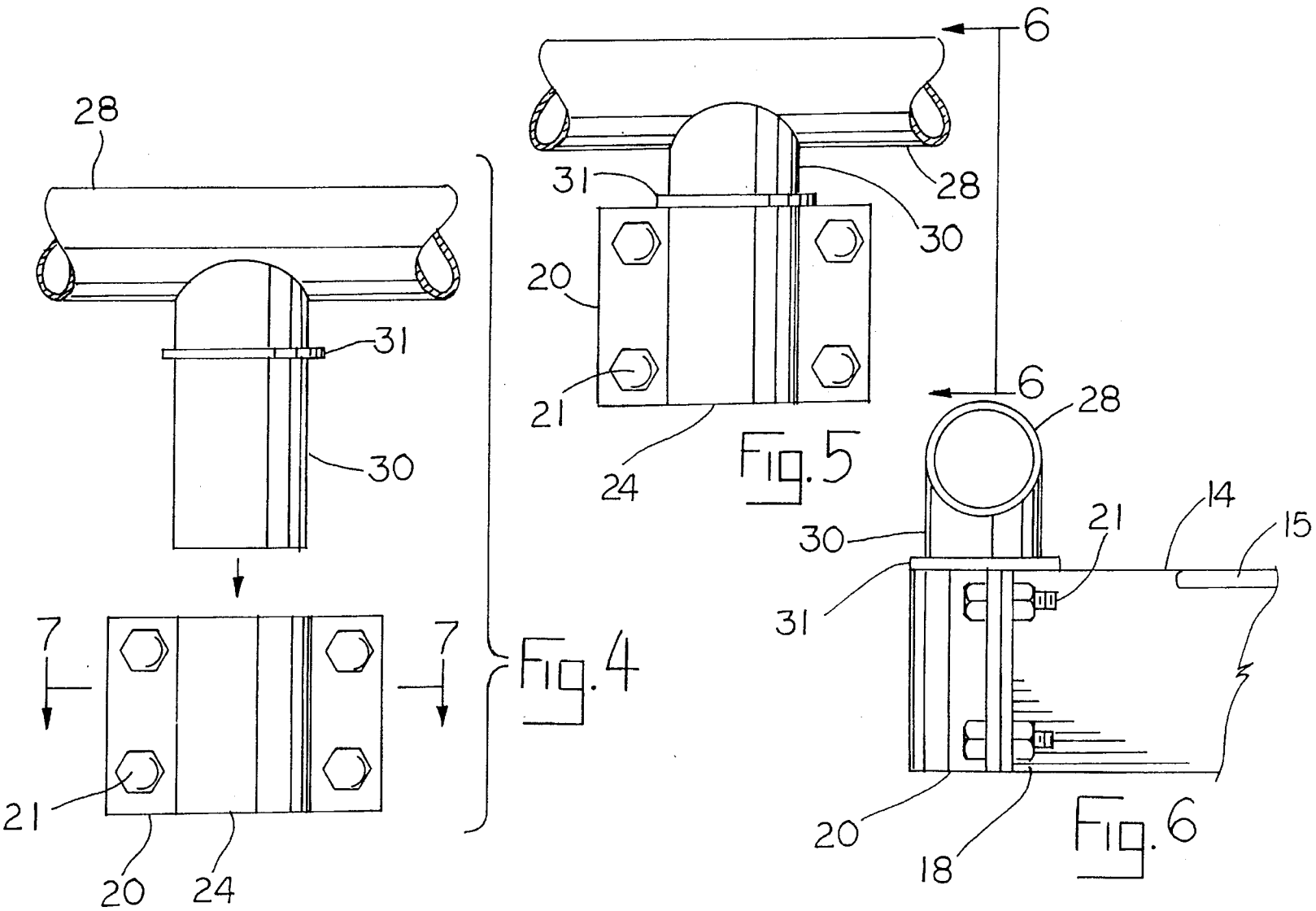
FIG. 4 is a fragmentary elevational view taken along line 4—4 in FIG. 3, but showing the cylindrical projection not yet installed within the pivot housing.
FIG. 5 is a fragmentary elevational view similar to FIG. 4, but showing the cylindrical projection installed within the pivot housing.
FIG. 6 is a fragmentary elevational view taken along line 6—6 of FIG. 5.

The preferred embodiment described herein is not intended to be exhaustive or to limit the invention to the precise form disclosed. The following embodiments are chosen and described to explain the principles of the invention as well as its practical use and application in order to best enable others skilled in the art to follow its teachings.

Referring now to the drawings, an antenna support assembled according to the present invention is generally indicated by the reference numeral 10, and includes substantially vertical tower or mast 12. A support arm 14 is attached to mast 12 by bracket 13, and extends outward from mast 12. Support arm 14 includes a pair of safety rails 15 attached at intervals to arm 14 and running parallel to arm 14. Pivot housing 16 is mounted to the outward end of support arm 14. Pivot housing 16 is comprised of flange part 18 and cap part 20. Flange part 18 defines the outward most end of support arm 14, and cap part 20 is attached to the outward face of flange part 18 by adjustable fasteners 21. Flange part 18 includes an arcuate portion 22, while cap part 20 includes an arcuate portion 24. A circular gap 26 is defined between flange part 18 and cap part 20.

Cross member 28 includes cylindrical projection 30. Projection 30 of cross member 28 is disposed within circular gap 26 of pivot housing 16, allowing cross member 28 to pivot to various positions. Adjustable fasteners 21 are used to maintain cross member 28 in the desired position by providing a frictional force on projection 30. Projection 30 includes annular bearing ring 31 which provides a bearing surface, thus allowing smooth rotation of cross member 28.

Antenna mounting post 32 is mounted to cross member 28 by pivot clamp 34. Pivot clamp 34 allows mounting post 32 to pivot about cross member 28. Pivot clamp 34 includes adjustable fasteners 36 to allow mounting post 32 to pivot about cross member 28 and then be secured in the desired position. Antenna mounting plate 38 is mounted to post 32 by fasteners 40, and antenna device (not shown) is mounted to plate 38.

In operation, service or maintenance personnel can access the antennas mounted on antenna support 10 by climbing mast 12 using conventional means such as steps. Upon reaching the level of support arm 14, a person can access the adjustable fasteners 21 by climbing outward along support arm 14, while using safety rail 15 to provide attachment points for a safety harness. Once fasteners 21 are loosened, cross member 28 can be pivoted about pivot housing 16 so that one end of cross member 28 is positioned close to mast 12, thereby allowing further servicing, adjusting, or replacement of the antenna from the relative safety of the mast 12. This further enables an antenna to be serviced or replaced without having to carry heavy tools or a new antenna assembly out to the end of the arm 14. The position of post 32 on cross member 28 can be changed by adjusting fasteners 36 on clamp 34, which allows the post to be pivoted about cross member 28 in order to achieve the best position or angle for signal reception. Further, each antenna assembly on the support 10 can be tuned in a wide variety of directions by adjusting clamp 34 and/or pivot housing 16.

Figure 8:
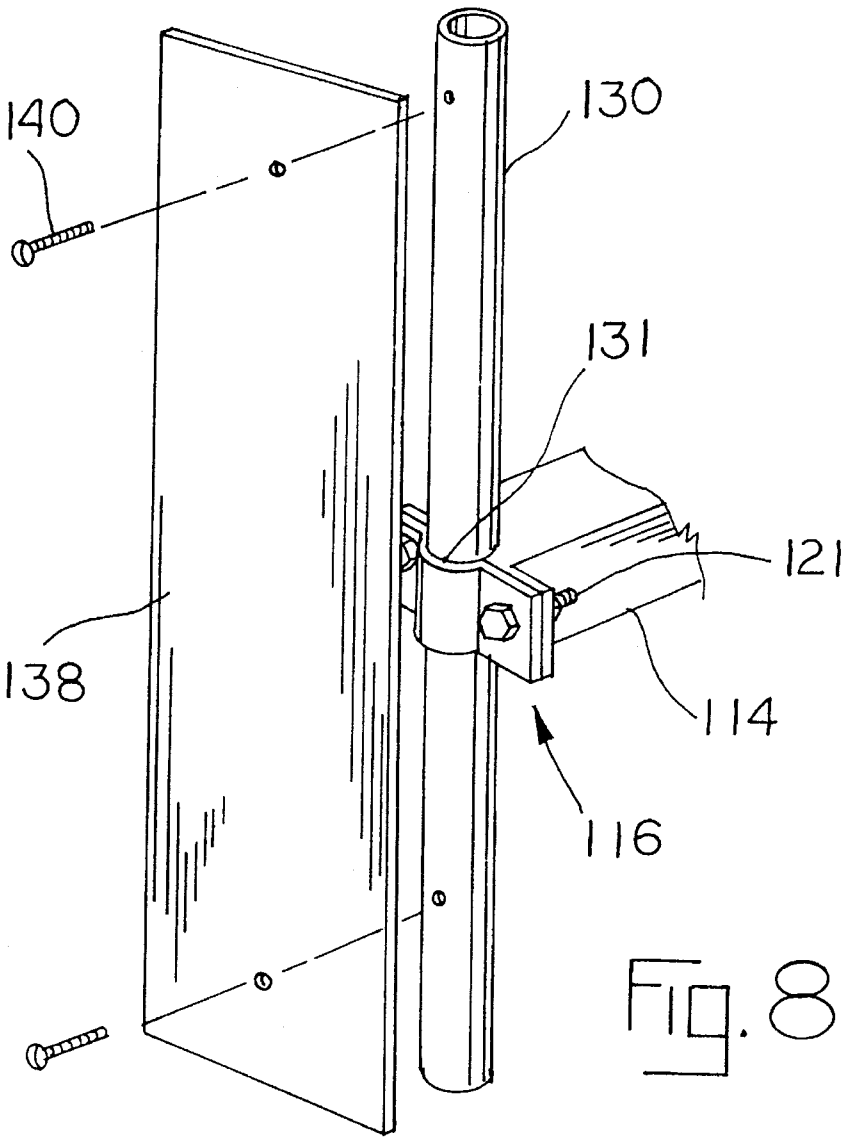
FIG. 8 is a fragmentary perspective view showing an alternate embodiment of the present invention.
Figure 7:
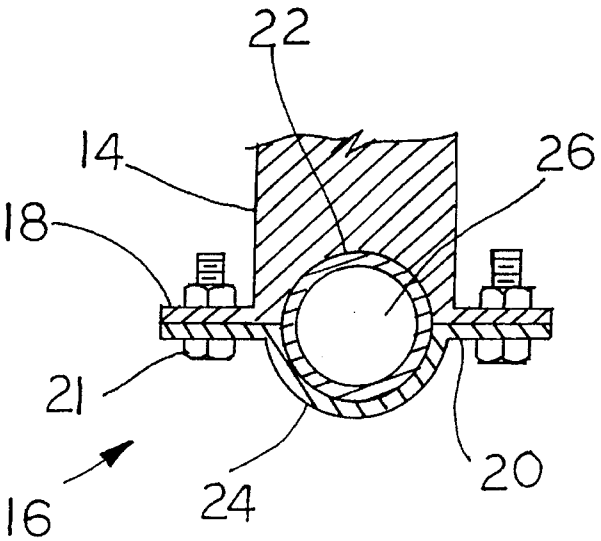
FIG. 7 is fragmentary sectional view taken along line 7—7 of FIG. 4, showing the circular gap in the pivot housing for receiving the cylindrical projection.

FIG. 8 illustrates a second embodiment of the claimed invention, in which the elements are the same or substantially the same as those in the embodiment of FIGS. 1-7 and retain the same reference characters, but increased by 100.

Cylindrical post 130 is disposed within circular gap 126 of pivot housing 116, allowing post 130 to pivot to various positions. Adjustable fasteners 121 are used to maintain post 130 in the desired position by providing a frictional force on post 130. Post 130 includes annular bearing ring 131 which provides a bearing surface, thus allowing smooth rotation of post 130. Antenna mounting plate 138 is mounted to post 130 by fasteners 140, and antenna device (not shown) is mounted to plate 138 using conventional means.

It is understood that the above description does not limit the invention to the above-given details, but may be modified within the scope of the following claims.

What is claimed:

1. Antenna support structure comprising:

a mast;

an antenna support arm mounted on said mast and extending outwardly from said mast;

a cross member mounted on said support arm and carrying antenna mounting means for mounting an antenna on said cross member;

first pivot means pivotally mounting said cross member to said support arm and permitting said cross member to swing relative to said arm to permit one end of said cross member to swing toward said mast when the cross member is swing in one direction and the other end of the cross member to swing toward said mast when the cross member is swung in the other direction; and second pivot means pivotally mounting said antenna mounting means on said cross member to permit said antenna mounting means to pivot about said cross member.

2. The antenna support of claim 1 wherein said cross member includes a vertical projection for engaging said first pivot means.

3. The antenna support of claim 2 wherein said vertical projection is cylindrical, said projection including an annular bearing ring, said bearing ring for supporting said cross member on said first pivot means and further for providing a rotational bearing surface.

4. The antenna support of claim 3 wherein said first pivot means includes a flange part attached to the outward end of said support arm, and further including an arcuate cap part for mounting to the outward face of said flange part, said flange part and said arcuate cap part defining a gap therebetween for complimentary receiving said vertical projection therein.

5. The antenna support of claim 4 wherein said first pivot means includes adjusting means for adjusting said first pivot means from a first position wherein said cross member is fixed relative to said support arm, to a second position wherein said cross member is free to pivot relative to said support arm.

6. The antenna support of claim 1 wherein said antenna mounting means includes a mounting post for mounting an antenna, said mounting post being rotatable about said cross member.

7. The antenna support of claim 1 wherein said support arm includes at least one safety rail mounted to said support arm and extending parallel to said support arm, said safety rail being attached at intervals to said support arm.

8. Antenna support structure comprising:

a mast;

at least one radially extending mounting bracket attached to said mast;

an antenna support arm mounted to said mounting bracket and extending radially outward from said mast;

a cross member mounted on said support arm and carrying antenna mounting means for mounting antenna on said cross member;

first pivot means pivotally mounting said cross member to said support arm and permitting said cross member to swing relative to said arm to permit one end of said cross member to swing toward said mast when the cross member is swung in one direction and the other end of the cross member to swing toward said mast when the cross member is swung in the other direction; and second pivot means pivotally mounting said antenna mounting means on said cross member to permit said antenna mounting means to pivot about said cross member.

9. The antenna support of claim 8 wherein said cross member includes a vertical projection for engaging said first pivot means.

10. The antenna support of claim 9 wherein said vertical projection is cylindrical, said projection including an annular bearing means, said bearing means for supporting said cross member on said first pivot means and further for providing a rotational bearing surface.

11. The antenna support of claim 9 wherein said first pivot means includes a flange part fixedly attached to the outward end of said support arm, and further including an arcuate cap part fixedly attached to the outward face of said flange part, said flange part and said arcuate cap part defining a gap therebetween for complimentary receiving said vertical projection therein.

12. The antenna support of claim 11 wherein said first pivot means includes adjusting means for adjusting said first pivot means from a first position wherein said cross member is fixed relative to said support arm, to a second position wherein said cross member is free to pivot relative to said support arm.

13. The antenna support of claim 8 wherein said support arm includes at least one safety rail in spaced apart parallel relationship with said support arm, said safety rail being affixed at intervals to said support arm.

14. Antenna support structure comprising:

a mast;

an antenna support arm mounted on said mast and extending outwardly from said mast;

an antenna mounting post mounted on said support arm and carrying an antenna mounting means;

pivot means pivotally mounting said mounting post to said support arm and permitting said mounting post to pivot relative to said arm to permit said antenna mounting means to be pointed in a number of different directions, wherein said pivot means includes a flange part fixedly attached to the outward end of said support arm, and further including an arcuate cap part fixedly attached to the outward face of said flange part, said flange part and said arcuate cap part defining a gap therebetween for complimentary receiving said mounting post therein; and said antenna mounting post including an annular bearing means, said bearing means for supporting said mounting post on said pivot means and further for providing a rotational bearing surface.

15. The antenna support of claim 14 wherein said pivot means includes adjusting means for adjusting said pivot means from a first position wherein said mounting post is fixed relative to said support arm, to a second position wherein said mounting post is free to pivot relative to said support arm.

16. The antenna support of claim 14 wherein said support arm includes at least one safety rail in spaced apart parallel relationship with said support arm, said safety rail being affixed at intervals to said support arm.

* * * * *